US007728498B2

(12) United States Patent
Shonka et al.

(10) Patent No.: US 7,728,498 B2
(45) Date of Patent: Jun. 1, 2010

(54) INDUSTRIAL HOLLOW CATHODE

(75) Inventors: Chris M. Shonka, Ft. Collins, CO (US); James R. Kahn, Ft. Collins, CO (US); Harold R. Kaufman, Laporte, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 575 days.

(21) Appl. No.: 11/639,639

(22) Filed: Dec. 16, 2006

(65) Prior Publication Data

US 2007/0222358 A1 Sep. 27, 2007

Related U.S. Application Data

(60) Provisional application No. 60/785,827, filed on Mar. 25, 2006.

(51) Int. Cl.
*H01J 1/20* (2006.01)

(52) U.S. Cl. ..... 313/339; 313/326

(58) Field of Classification Search ..... 313/339
See application file for complete search history.

(56) References Cited

U.S. PATENT DOCUMENTS 4,218,633 A * 8/1980 Mirtich et al. ..... 313/362.1
4,862,032 A 8/1989 Kaufman et al.
5,587,093 A 12/1996 Aston
2004/0000853 A1* 1/2004 Kaufman et al. ..... 313/339

OTHER PUBLICATIONS

Delcroix et al.,vol. 35, Advances in Electronics and Electron Physic-New York, 1974, beginning on p. 87.
Kaufman et al., AIAA Journal, vol. 20 (1982), beginning at p. 745.
Zhurin et al., Plasma Sources Science & Tech., vol. 8, beginning p. R, 1999 Printed in the UK.
Kaufman, vol. 36, Advances in Electronics & Electron Physics, beginning on p. 265, 1974.
Nakanishi et al., Journal of Spacecraft and Rockets, vol. 11, beginning on p. 560, Aug. 1974.
Zuccaro, AIAA paper 73-1140 (1973).
Spangenberg, Vacuum Tubes, McGraw-Hill Co., New York (1948), p. 809.
Dushman, Scientific Foundations of Vacuum Techniques, John Wiley & Sons, New York (1962), p. 624.

* cited by examiner

*Primary Examiner*—Peter J Macchiarolo
*Assistant Examiner*—Donald L Raleigh
(74) *Attorney, Agent, or Firm*—Dean P. Edmundson

(57) ABSTRACT

In accordance with one embodiment, the hollow cathode is comprised of a first tantalum tube, tantalum foil, and a second tantalum tube. The foil is in the form of a spiral winding around the outside of the first tube and is held in place by the second tube, which surrounds the foil. One end of the second tube is approximately flush with one end of the first tube. The other end of the second tube extends to a cathode support through which the working gas flows. To start the cathode, a flow of ionizable inert gas, usually argon, is initiated through the hollow cathode and out the open end of the first tube. An electrical discharge is then started between an external electrode and the first tube. When the first tube is heated to operating temperature, electrons are emitted from the open end of the first tube.

16 Claims, 7 Drawing Sheets

INDUSTRIAL HOLLOW CATHODE

CROSS-REFERENCE TO RELATED APPLICATION

This application is based upon and claims benefit of Provisional Application No. 60/785,827 filed Mar. 25, 2006.

FIELD OF INVENTION

This invention relates generally to hollow cathodes, and more particularly it pertains to hollow cathodes used to emit electrons in industrial applications.

BACKGROUND ART

Hollow cathodes are used to emit electrons in a variety of industrial applications. As described in a chapter by Delcroix, et al., in Vol. 35 of *Advances in Electronics and Electron Physics* (L. Marton, ed.), Academic Press, New York (1974), beginning on page 87, there are both high and low pressure regimes for hollow-cathode operation. In the high-pressure regime, the background pressure (the pressure in the region surrounding the hollow cathode) approaches or exceeds 1 Torr (130 Pascals) and no internal flow of ionizable working gas is required for operation. In the low-pressure regime with a background pressure below 0.1 Torr, an internal flow of ionizable working gas is required for efficient operation. It is for operation in the low-pressure regime below 0.1 Torr, and usually below 0.01 Torr, that the present invention is intended.

An important industrial application of low-pressure hollow cathodes is for electron emission in ion sources. These ion sources are of both gridded and gridless types. The ions generated in gridded ion sources are accelerated electrostatically by the electric field between the grids. Gridded ion sources are described in an article by Kaufman, et al., in the *AIAA Journal*, Vol. 20 (1982), beginning on page 745. The particular sources described in this article use a direct-current discharge to generate ions. It is also possible to use electrostatic ion acceleration with a radio-frequency discharge, in which case the only electron emitting requirement would be for a neutralizer cathode.

In gridless ion sources the ions are accelerated by the electric field generated by an electron current interacting with a substantial magnetic field in the discharge region, i.e., a magnetic field with sufficient strength to make the electron-cyclotron radius much smaller than the length of the discharge region to be crossed by the electrons. The closed-drift ion source is one type of gridless ion source and is described by Zhurin, et al., in an article in *Plasma Sources Science & Technology*, Vol. 8, beginning on page R1, while the end-Hall ion source is another type of gridless ion source and is described in U.S. Pat. No. 4,862,032—Kaufman, et al.

There are different types of low-pressure hollow cathodes. The simplest is a refractory-metal tube, usually of tantalum. This type is described in the review by Delcroix, et al., in the aforesaid chapter in Vol. 35 of *Advances in Electronics and Electron Physics*. For hollow cathodes of the sizes, electron emissions, and gas flows of most interest herein, the use of this cathode type results in a high heat loss and a lifetime of only a few tens of hours, even when operating with clean inert working gas. With the working-gas contamination levels often encountered in industrial environments, the lifetime could be reduced to only several hours.

The lifetime of this type of cathode can be extended by the use of radiation shields, which reduces the heat loss, which in turn reduces the energy of bombarding ions within the hollow cathode—see U.S. Patent Application Publication 2004/0000853—Kaufman, et al. With the proper design of radiation shields, the lifetime with clean working gas can be extended to several hundred hours or more. With contaminated working gas, however, the lifetime could again be reduced to several hours.

Another type of hollow cathode has been developed for electric thrusters used in space propulsion and is described in a chapter by Kaufman in Vol. 36 of *Advances in Electronics and Electron Physics* (L. Marton, ed.), beginning on p. 265. The distinguishing feature of this type is an emissive insert that emits electrons at a lower temperature, and hence with a lower heat loss, than does the plain metal-tube of the type described above. The major advantage of this type is the long lifetime that is possible, of the order of 10,000 hours. The major disadvantage is the sensitivity of the supplemental emissive material to contamination. This emissive material requires "conditioning" before initial operation and is sensitive to atmospheric exposure after this conditioning. For example, barium carbonate is often used as the supplemental emissive material, which is heated during conditioning to become an oxide. If this emissive material is exposed to air after conditioning, the barium oxide combines with the water vapor in the air to become a hydroxide, which is much less effective as an emission material. Repeated exposure to air is not a problem in the space electric-propulsion application for which these cathodes were originally designed, but is much more serious in industrial applications. The combination of sensitivity to contamination and high fabrication costs make this type of hollow cathode a poor choice for most industrial applications.

What might be called a compromise of the two types of hollow cathodes has been used in industrial applications. In this type, an emissive insert is used, but this insert consists only of tantalum foil. The lifetime is not as long without a low-work-function emissive material such as barium carbonate, but the tantalum-foil insert is less sensitive to atmospheric exposure than an insert that depends on the addition of an emissive material. It should be mentioned that a purge of working gas is normally used for a hollow cathode after exposure to atmosphere and prior to operation. This purge removes most of the impurities from the atmosphere that are adsorbed on the hollow-cathode surfaces, unless they are chemically combined with hollow-cathode material—such as in the formation of barium hydroxide by the water vapor in the atmosphere. However, even with the reduced sensitivity to atmospheric exposure, this type of cathode is still sensitive to impurities (contamination) in the working gas.

Another example of possible hollow-cathode configurations is U.S. Pat. No. 5,587,093—Aston, which differs from other examples given above mostly by additional complexity. There is described a hollow cathode with both multiple radiation shields surrounding a tube through which the working gas is introduced and an emissive insert that is impregnated with an emissive material. Unlike other emissive inserts described herein, this one is directly heated by an electrical current passing through the insert. There are also intervening support structures between both the gas tube and the inner radiation shield and between the inner and outer radiation shields. The contamination-sensitive emissive material and the complicated structure both make it a poor choice for operation with contaminated working gas.

A hollow cathode for industrial applications should have an operating lifetime of at least several hundred hours and be insensitive to repeated exposures to atmosphere between periods of operation. The effect of frequent exposures to atmosphere can be minimized by keeping a flow of clean inert gas through the cathode during these exposures (purging). Shorter lifetimes than several hundred hours would be a problem because the time between maintenance in many industrial applications would then be limited by the cathode lifetime. While longer lifetimes might be of interest for industrial hollow cathodes, the time between maintenance would probably still be limited by other system components. In other words, the cost of a longer-lifetime hollow cathode, together with any special care and handling required, would have to be balanced against the replacement cost of a new hollow cathode of a simpler type.

The best tolerance to atmospheric exposure has been obtained by fabricating the hollow cathode entirely of refractory materials and avoiding the more reactive materials that are used to impregnate or coat an emissive insert. Atmospheric contamination is limited to the surface of refractory materials and is mostly removed by a purge of clean gas before operation. Tolerance to contamination in the working gas, which is usually argon, is a more serious problem. Contaminated working gas reaches the cathode when it is hot and is more likely to react with and/or be absorbed into refractory metals. This contamination results from the use of dirty gas tubing, leaky tubing connections, unsuitable gas regulators, and improper procedures such as opening a new gas bottle without first pumping down the trapped volume between the gas bottle and the regulator. The contaminants involved are usually some combination of oxygen, nitrogen, water vapor, and hydrocarbons. Compared to the use of a clean working gas, typically >99.999% argon, such contamination can reduce the lifetime by a factor of ten or more. Controlling the purity of the working gas at all industrial locations is simply not practical. The approach taken herein has been to increase the tolerance of a hollow cathode to contamination in the working gas.

SUMMARY OF INVENTION

In light of the foregoing, it is a general object of the invention to provide a hollow cathode that is simple to fabricate and use, while having an operating life of at least several hundred hours using working gas contaminated with the typical impurities found in industrial applications.

Another general object of the invention is to provide a hollow cathode with an operating lifetime of at least several hundred hours that does not require conditioning before operation.

Yet another general object of the invention is to provide a hollow cathode, with an operating lifetime of at least several hundred hours, that does not degrade significantly due to atmospheric exposure between periods of operation.

A specific object of the invention is to provide a hollow cathode with an operating lifetime of at least several hundred hours that does not incorporate a supplemental emissive material.

Another specific object of the invention is to provide a hollow cathode that has a lifetime of at least several hundred hours while using a robust metallic part as the emissive surface.

Still another specific object of the invention is to provide a hollow cathode that minimizes thermal losses by not having a continuous thermal conduction path between the dense internal plasma and the cooler cathode support.

Yet still another specific object of the invention is to provide a hollow cathode that resists failure to contain the working gas by having a compressed laminar structure, resistant to cracking or leaking, in that part of the hollow cathode that is most likely to absorb and react with contaminants in the working gas.

A still further specific object of the invention is to provide a hollow cathode with an operating lifetime of at least several hundred hours that does not require a metallic resistive heater for starting.

In accordance with one embodiment of the present invention, the hollow cathode is comprised of a first tantalum tube, tantalum foil, and a second tantalum tube. The first tantalum tube has a diameter that is smaller than that of the second tube. The first tantalum tube is the electron emitter. The foil is in the form of a spiral winding, wrapped around the outside of the first tube, and comprises a plurality of radiation shields (the plurality comprising at least about ten shields, preferably twenty or more). The second tantalum tube surrounds both the first tube and the radiation shields, with one end of the second tube approximately flush with one end of the first tube. The second tube extends to a cathode support through which the working gas flows and to which the other end of the second tube is attached. The radiation shields are compressed between the large and small tantalum tubes, holding the shields in place inside the outer tube, and holding the first tantalum tube in place inside the radiation shields. This construction forces most of the working gas to flow through the first tube. To start the hollow cathode, a flow of ionizable inert gas, usually argon, is initiated through the hollow cathode and out the open end of the first tube. An electrical discharge is then started between an external electrode and the first tube, ionizing some of the molecules of the ionizable gas and forming an electrically conductive plasma that extends from the external electrode back into the open end of the first tube. When the first tube is heated to operating temperature, electrons are emitted from the open end of the first tube and conducted away from it by the plasma.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

DESCRIPTION OF PRIOR ART

Figure 1:
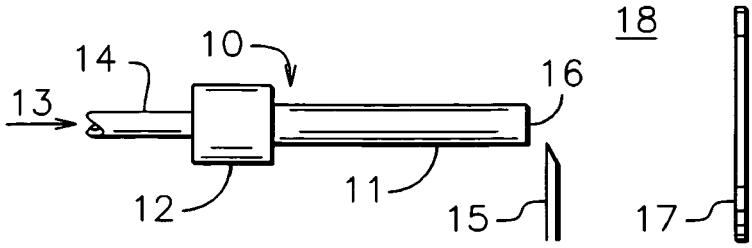
(PRIOR ART) Fig. 1
FIG. 1 is a prior-art hollow-cathode assembly.

Referring to FIG. 1, there is shown prior-art hollow-cathode assembly 10 of the type described by Delcroix, et al., in the aforesaid chapter in Vol. 35 of *Advances in Electronics and Electron Physics*. The hollow cathode is tube 11, which has a circular cross section and is fabricated of a refractory metal. Possible refractory metals include molybdenum, niobium, rhenium, tantalum, tungsten, or alloys of these metals, with tantalum the most common choice. Carbon is a refractory material that has also been used and is considered either a metal or nonmetal, depending on the particular field of study. It is considered a metal for the discussion herein. Cathode holder 12 supports hollow cathode 11, as well as conducting ionizable working gas 13 which is supplied to the cathode holder through feed tube 14. Igniter/keeper electrode 15 is located near open end 16 of hollow cathode 11. Further from open end 16 is anode 17. Hollow-cathode assembly 10 operates in surrounding volume 18.

Figure 2:
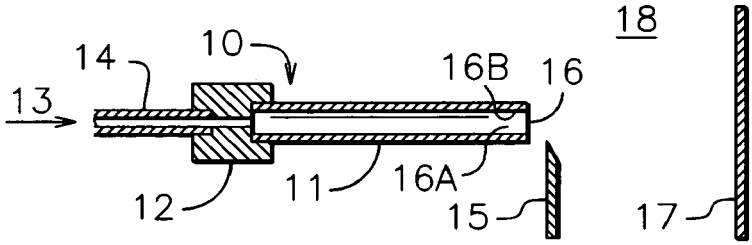
(PRIOR ART) Fig. 2
FIG. 2 shows a cross section of the prior-art hollow-cathode assembly of FIG. 1.

A cross section of the prior-art hollow-cathode assembly of FIG. 1 is shown in FIG. 2. The operation of interest herein is what Delcroix, et al., refer to as a hollow cathode arc (HCA), with the potential difference between the anode and cathode ≦50 V. Further, it is in the low-pressure regime in which the background pressure (the pressure in surrounding volume 18) is ≦0.1 Torr (≦13 Pascals). It is apparent to one skilled in the art that this low operating pressure also requires the use of a vacuum pump and a vacuum chamber enclosing volume 18, both of which are not shown in FIG. 1 or 2.

To obtain normal operation (≦50 V) in the low-pressure regime, it is necessary to supply a sufficient flow of ionizable working gas 13 to the hollow cathode so that the pressure in volume 16A, within and near open end 16 of cathode 11, is of the order of one Torr (133 Pascals). In operation, there is an electrical discharge between cathode 11 and either or both of igniter/keeper electrode 15 and anode 17. This discharge generates electrons and ions by ionization of atoms or molecules of the working gas. Some of the ions are carried with the flow of working gas and, together with the emitted electrons form a conductive plasma that extends from volume 16A inside cathode 11 to the igniter/keeper electrode and the anode.

Electrons created by the ionization of atoms or molecules of the ionizable working gas constitute some of the electron emission from the hollow cathode, but a major part of this emission comes from surface 16B inside the open end of the hollow cathode. This emission includes secondary electrons from ion bombardment, as well as enhanced emission due to high electric fields, but is primarily thermionic in nature. A thermionic-emission temperature is required for surface 16B for this emission to take place.

The thermionic-emission temperature near the open end is maintained primarily by ion bombardment. The electrical conductivity of the plasma extending from the cathode to the anode is high enough that most of the discharge voltage appears between the plasma and the cathode. If the emission is low, the discharge voltage rises, increasing the energy of the ions bombarding surface 16B, thereby increasing the surface temperature. Conversely, if the emission is high, the discharge voltage decreases, decreasing the energy of the ions bombarding that surface, thereby decreasing that surface temperature. In this manner, controlling to a given emission results in the discharge voltage varying to maintain the emission surface within a narrow temperature range. In addition, thermionic electron emission varies extremely rapidly with emitter temperature, which means that a wide range of electron emissions corresponds to a narrow range of emission-surface temperatures. The net result is that, for a given emission-surface material, there will be a narrow range of emitter temperature for a wide range of operating conditions and configurations. For tantalum, that narrow temperature range is near 2400-2500 K.

The ions bombarding surface 16B also cause erosion, thereby limiting the lifetime of hollow cathode 11. To reduce the erosion and increase the lifetime, it is necessary to reduce the discharge voltage. To maintain the temperature of surface 16B in the 2400-2500 K operating range while, at the same time, reducing the discharge voltage, it is necessary to decrease the heat loss that is offset by the energy of the bombarding ions. The heat loss consists primarily of radiation from the hot surfaces and conduction in the continuous support paths from these hot surfaces to colder bodies, such as along hollow-cathode tube 11 extending from hot surface 16B to colder support 12. Those skilled in the art will recognize that electron emission and the heating of the working gas also constitute heat loss mechanisms for hot surface 16B, but should also recognize that the magnitudes of these heat losses are small compared to the radiation and conduction losses.

Figure 3:
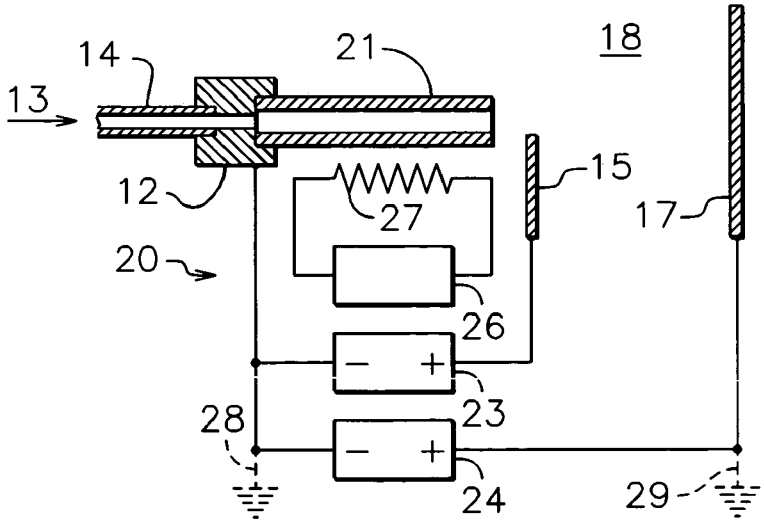
(PRIOR ART) Fig. 3
FIG. 3 shows a prior-art electrical circuit diagram of a hollow cathode.

Referring to FIG. 3, there is shown prior-art electrical circuit diagram 20 for hollow cathode 21. Igniter/keeper power supply 23 provides a positive potential to the igniter/keeper electrode 15 relative to cathode 21. Note that cathode 21 may be prior-art hollow cathode 11 or some other hollow cathode. When electrode 15 is functioning as an igniter, a high voltage of at least several hundred volts and usually approximately 1 kV is supplied by power supply 23 to initiate the discharge. The requirement for a voltage of at least several hundred volts results from the need to generate an electrical breakdown in the ionizable working gas. This breakdown results from imposing a voltage greater than the Paschen-law minimum, which varies with the working gas used but ranges from about 400-600 V. If there is also a need to heat the cathode to an operating temperature, the voltage is usually in the range of 600-1500 V, or approximately 1 kV. After the discharge is started, a sustaining keeper discharge of ≦50 V and ≧1 A can be used. Electrode 15 and power supply 23 can thus act as igniter and igniter power supply, keeper and keeper supply, or both.

Still referring to FIG. 3, discharge power supply 24 provides a positive potential to anode 17 relative to hollow cathode 21, causing a discharge current to the anode which consists primarily of electrons emitted by hollow cathode 21 and arriving at the anode. In normal operation the discharge is ≦50 V. Delcroix, et al., also give an electron emission current of several amperes or more for normal operation, but minimum emissions of 1-2 A have been found by others. This difference in minimum emission (the total current to both ignitor/keeper 15 and anode 17) is attributed to the larger hollow-cathode exit openings used by Delcroix, et al. Delcroix, et al., typically used apertures several millimeters in diameter, compared to the approximately 1 millimeter exit diameter used by those finding lower minimum emissions.

Power supply 24 may also incorporate a high-voltage starting circuit of at least several hundred volts and usually approximately 1 kV. If there is such a starting circuit incorporated in power supply 24, ignitor/keeper electrode 15 and igniter/keeper power supply 23 could be omitted. Anode 17 is shown in cross section as being made of metal, which is often the case. The anode may also be the entire vacuum chamber, instead of an electrode within it. When used with an ion source, the anode may be the quasi-neutral plasma of an ion beam, i.e., not a metallic electrode.

Heater power supply 26 energizes resistive heater 27 to bring hollow cathode 21 to operating temperature. This power supply may be of either the direct or alternating current type. When a metallic resistive heater is used, radiation shields may surround the resistive heater to reduce the electrical power required for the hollow cathode to reach operating temperature. If the cathode is heated to operating temperature by igniter/keeper supply 23, power supply 26 and resistive heater 27 could be omitted.

Different ground connections may be used. The surrounding vacuum chamber is typically defined as ground potential and is often, but not always, at earth ground. If the cathode is at the potential of the surrounding vacuum chamber, the ground connection would be as shown by ground 28. If the anode is the surrounding vacuum chamber, the ground connection would be as shown by ground 29. In the latter case, electrical isolation would be required in the gas line which, far from the cathode, would also be at ground potential. The techniques for such electrical isolation are well known to those skilled in the art and are not pertinent to the present invention.

The preceding description of the electrical circuit diagram of FIG. 3 should make clear that a variety of electrical circuit options are possible. Regardless of the particular options selected, the electrical circuit must initiate the discharge from the hollow cathode, with the heating of the hollow cathode to operating temperature provided either prior to the initiation of discharge or during that initiation. If the heating is prior to the initiation of the discharge, a maximum of several hundred Volts will usually be sufficient for this initiation, rather than the previously mentioned approximately 1 kV. Following the initiation of the discharge, a normal discharge is sustained at $\leqq$50 V. This sustained discharge can be directly to the anode, or it can be to a keeper electrode. In the latter case, a pre-existing discharge to the keeper can provide rapid initiation of a normal discharge to an anode, without a large potential being applied to that anode. In this sense, the keeper discharge "keeps" the cathode ready for normal operation.

The simple tubular cathode of Delcroix, et al., has a limited lifetime, typically a few tens of hours in the sizes and operating conditions of interest for ion sources. Delcroix, et al., do not discuss the effect of working gas on lifetime, but the use of an inert gas such as argon, krypton, or xenon would be required to reach even this limited lifetime. A reactive gas such as oxygen or nitrogen would result in much shorter lifetimes. Nitrogen is considered inert in many applications, but is reactive in the environment of an electrical discharge.

As a measure of tubular-cathode lifetime at operating conditions of interest, a tantalum tube 1.57 mm in outside diameter and 38 mm long, with a wall thickness of 0.38 mm was operated with a clean argon gas flow of 10 sccm (standard cubic centimeters per minute). The igniter/keeper current was 1.5 A (power supply 23 in FIG. 3) and the emission was 5 A (power supply 24 in FIG. 3), giving a total electron emission of 6.5 A. The pressure in surrounding volume 18 was less than 0.001 Torr. A cathode assembly with an enclosed ignitor/keeper was used, similar to that to be discussed in connection with FIGS. 8 and 9. This hollow cathode was operated with an ion source that was generating an ion beam. The ion beam and surrounding plasma constituted the anode for the discharge. The most direct measurement of the discharge voltage was the voltage of the keeper supply (power supply 23), which was 16-17 V over most of the life test. Operation was periodically interrupted and the cathode exposed to atmosphere for wear measurements. The limit in lifetime was reached when the cathode could not be restarted at a gas flow of about 40 sccm (four times the operating gas flow). The operating lifetime was about 60±20 hours for the simple tubular cathode at these conditions. While such a lifetime may be adequate for some applications, it is far too short for the electron emission functions of many industrial ion sources. On the other hand, exposure to atmosphere had no significant adverse effect on the simple tubular cathode. While an adsorbed layer of impurities would be expected from exposure to atmosphere, this layer is thin and would be mostly removed during the purge of clean working gas used after exposure to atmosphere and prior to operation.

The use of radiation shields is discussed by Delcroix, et al., in the aforesaid chapter in Vol. 35 of *Advances in Electronics and Electron Physics*. The use of two cylindrical radiation shields is shown in the figure on page 147 and the discussion on pages 145-146 therein to result in a drop in discharge voltage from about 44 V to about 35 V. While Delcroix, et al., find this drop worth noting, there is no indication of a possible effect on lifetime. On pages 147-148 therein, the total radiation from an unshielded cathode is estimated at 15-20% of the total discharge power. While this result is also worth noting, there is again no indication of a possible qualitative effect on lifetime that can be obtained by reducing radiation losses.

To obtain a lifetime for the double-shielded configuration described above, a 1.57-mm-diameter, 38-mm-long hollow cathode (similar to that described previously) was operated with two concentric cylindrical tantalum shields having outside diameters of 9.5 mm and 3.18 mm. The thicknesses of these shields were approximately the same 0.38-mm thickness as the tantalum tube. Using the same operating conditions as were used for the simple tantalum tube hollow cathode, the initial keeper voltage was 13-14 V, significantly lower than the 16-17 V obtained with the simple tubular cathode and qualitatively in agreement with the reduced operating voltage described by Delcroix, et al. However, the keeper voltage increased more rapidly than was observed with the simple tubular cathode and there was no significant increase in operating lifetime over that cathode. The rapid degradation of simple radiation shields, with only several shields and no texturing of those shields, has been observed before. This degradation is believed due to the welding together of the shields, providing a direct thermal conduction path through those shields.

Figure 4:
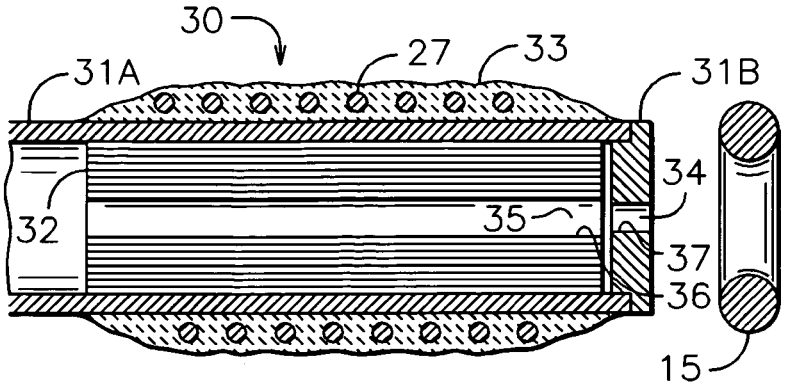
(PRIOR ART) Fig. 4
FIG. 4 shows a cross section of another prior-art hollow cathode.

Referring to FIG. 4, there is shown a cross section of another prior-art hollow cathode, the space-propulsion hollow cathode described by Kaufman in the aforesaid chapter in Vol. 36 of *Advances in Electronics and Electron Physics*. Cathode 30 has a cathode body that is comprised of tantalum tube 31A with a circular cross section that is electron-beam welded to tungsten tip 31B. Inside the tantalum tube and also part of the hollow cathode is a spiral wound tantalum-foil insert 32. The tantalum foil from which the insert is fabricated is 0.013 mm thick. The foil in this insert was coated with a low-work-function, low-temperature emissive material, barium carbonate, which becomes barium oxide during initial heating or conditioning of the cathode. Outside the tantalum tube and also part of the hollow cathode is resistive heater 27 imbedded in flame-sprayed alumina 33. Igniter/keeper 15 is spaced from the open end of the cathode and has an annular shape.

Hollow cathode 30 is brought to approximately operating temperature when resistive heater 27 is energized by a heater power supply (see power supply 26 in FIG. 3). With a flow of ionizable working gas (mercury vapor in this case), a discharge is initiated by a positive voltage of several hundred volts on igniter/keeper electrode 15 relative to cathode body 31A/31B. This discharge is then sustained by a 1-2 A current to igniter/keeper electrode 15. The electron emission is through opening 34, which is reduced in diameter from the inside diameter of tantalum tube 31A. The electrons that pass through the aperture come from volume 35 adjacent to the aperture, and are believed to mostly originate from internal insert surface 36 adjacent to volume 35. The lower cathode tip temperature (1400-1500 K) of this cathode type compared to that of the configuration in FIGS. 1 and 2 is attributed to the lower work function of the oxide-coated insert.

As described by Nakanishi, et al., in an article in *Journal of Spacecraft and Rockets*, Vol. 11, beginning on page 560, operating lifetimes of the order of 10,000 hours have been demonstrated with the type of hollow cathode shown in FIG. 4. Much of this increased lifetime can be attributed to the lower operating temperature, and the reduced energy of bombarding ions that is sufficient to maintain this reduced temperature. However, exposure to atmosphere rapidly degraded the electron emission characteristics of the emission material—see Zuccaro in *AIAA Paper* 73-1140, 1973. This degradation was not observed with storage in either an inert gas (argon) or a vacuum.

The heat losses of the prior-art hollow cathode shown in FIG. 4 are again by radiation and conduction, but the heat loss paths are more complicated than those for the hollow-cathode shown in FIGS. 1 and 2 because of the more complicated construction. The heating of the emissive surface is again by ion bombardment from the conductive plasma that extends back into the hollow cathode. The emissive surface is insert surface 36 and the ion bombardment is from ions coming from the conductive plasma that extends back into volume 35. Insert 32 consists of a spiral winding of tantalum foil, where the layers of foil serve as radiation shields for heat flow in the radial direction. Ultimately, the heat flow into insert 32 by ion bombardment must leave by radiation to tantalum tube 31A and tungsten tip 31B, and from there by conduction to the cathode support (not shown in FIG. 4). (Those skilled in the art of vacuum technology will recognize that simple contact between insert 32 and surrounding tube 31A does not result in significant thermal conduction between the two and the heat transfer is primarily by radiation.) However, there is another major heat loss path. The electrically conductive plasma is most dense in volume 35 and the volume in opening 34, becoming less dense outside of tip 31B where the current density of emitted electrons decreases. The surface inside opening 34, surface 37, therefore receives ion-bombardment heating in an amount comparable to that of emissive surface 36, and this heat can be conducted through tip 31B and tube 31A to the cathode support. The dual paths for heat loss (through both the insert and the tip) presumably increase the discharge voltage required for maintaining emissive surface 36 at emissive temperature, but are not a serious problem because the operating temperature for the emissive surface is so low (1400-1500 K).

The use of electrode 15 as a keeper electrode permitted electron emission to be available for the subsequent initiation of ion-source operation without having to make that initiation simultaneous with starting the hollow cathode. For example, it was desirable to have the neutralizer hollow cathode ready to emit electrons before an ion beam is initially accelerated, and not to generate an unneutralized ion beam with the attendant high accelerator-grid impingement while the neutralizer hollow cathode was started.

Figure 5:
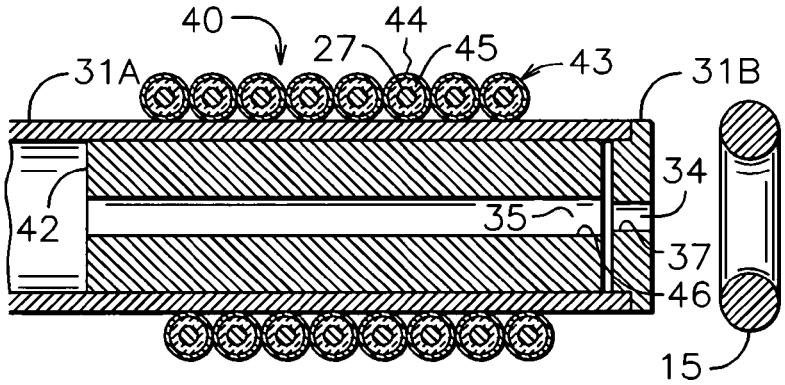
(PRIOR ART) Fig. 5
FIG. 5 shows a cross section of yet another prior-art hollow cathode.

Referring to FIG. 5, there is shown yet another prior-art hollow cathode, a space-propulsion hollow cathode described by Zuccaro in the aforementioned *AIAA Paper* 73-1140, 1973. Hollow cathode 40 differs from the one shown in FIG. 4 in having porous-tungsten insert 42 in place of spiral-wound foil insert 32. The pores of the porous tungsten are impregnated with an emissive material, barium carbonate. Another difference is that resistive heater 27 is enclosed in swaged composite structure 43 consisting of outer metal tube 44, resistive heater 27, and insulator 45 between the two.

The operation of hollow cathode 40 is similar in all important aspects to that of hollow cathode 30 described in connection with FIG. 4, including both the long life and the degradation of the emission material due to exposure to atmosphere. The function and performance of the spiral-wound foil insert are generally similar to those of the porous-tungsten insert, with both serving as long-duration dispensers of emissive material. Porous-nickel inserts impregnated with emissive material have been used elsewhere with similar results. Reliability of resistive heater 27 has been an recurrent problem with both designs shown in FIGS. 4 and 5. The space-propulsion hollow cathodes shown in FIGS. 4 and 5 are from publications that are several decades old. However, more recent space-propulsion hollow cathodes are similar, as shown by U.S. Pat. No. 6,380,685—Patterson, et al. The heat loss paths for the hollow cathode shown in FIG. 5 are also similar to those for FIG. 4, starting with emissive surface 46 and surface 37 inside opening 34. There is the minor difference that there are no internal radiation shields in insert 42. Again, the dual paths for heat loss are not a serious problem because the operating temperature for the emissive surface is so low (1400-1500 K).

Figure 6:
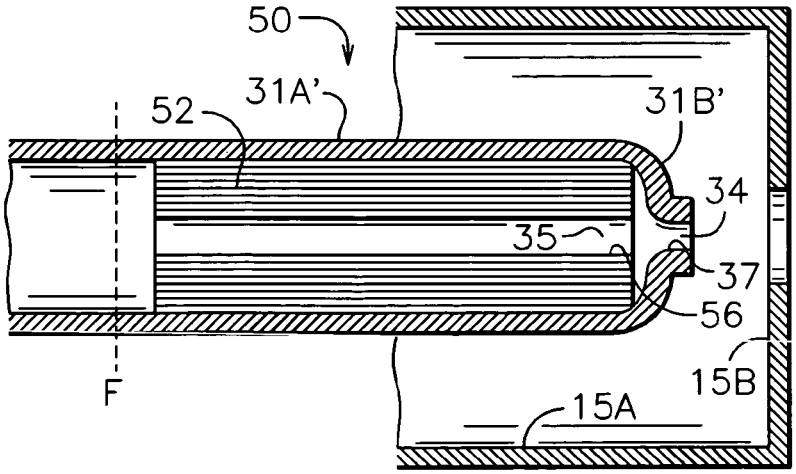
(PRIOR ART) Fig. 6
FIG. 6 shows a cross section of a still another prior-art hollow cathode.

Referring to FIG. 6, there is shown a cross section of still another prior-art hollow cathode. Hollow cathode 50 is the compromise mentioned in the Background Art section and has been marketed as the HCES 1000 and HCES 5000 by Commonwealth Scientific Corporation and more recently by Veeco Instruments Inc. The cathode body is comprised of tantalum tube 31A' having a circular cross section and tip 31B' and is formed by swaging a tantalum tube to a small diameter at the open end. Although the cathode body is fabricated in a different manner than the cathode bodies of prior-art hollow cathodes 30 and 40, the functions of all three are the same. Tantalum-foil insert 52 is generally similar to insert 32 in FIG. 4, except that insert 52 is not coated with emissive material. The tantalum foil used for this insert is textured (with a large plurality of small dents or wrinkles) to minimize layer-to-layer contact. The igniter/keeper is comprised of cylindrical wall 15A and apertured end 15B, and is of an enclosed design. The enclosed ignitor/keeper will be described further in connection with FIG. 8.

The lack of an additional emissive material on the spiral wound tantalum-foil insert 52 of hollow cathode 50 has both adverse and beneficial effects when compared to hollow cathodes 30 and 40 that incorporate emissive material. The operating lifetime is reduced from thousands of hours to several hundred hours, but is still adequate for most industrial applications when operating on clean working gas. The adverse effect of atmospheric exposure is also reduced. With no emissive material to degrade with atmospheric exposure, the cathode performance degradation is also less severe. Repeated exposure of the foil insert to atmosphere, however, still results in embrittlement and flaking of the foil insert, with the flakes eventually plugging the central passage in the insert through which the ionizable working gas flows. The embrittlement and flaking is believed due primarily to adsorbed layers of water vapor accumulated during atmospheric exposure on the extended surface area of the spiral-wound foil insert. As the result of the layered structure of this foil insert, much of this water vapor (or other atmospheric contaminants) is not removed during purging, and is present to react chemically with the tantalum foil as it heats up to operating temperature. There can also be a failure of tantalum tube 31A' at approximately the axial location indicated by the dashed line F shown in FIG. 6. This failure can be due to the formation of cracks in tube 31A' that permit much of the working gas to escape before reaching opening 34, thus preventing either the starting or the normal operation of the hollow cathode. The failure can also be more dramatic in that tube 31A' completely separates at that location. This type of failure is discussed further near the end of this section.

The mechanisms and paths for heat loss in the prior art hollow-cathode of FIG. 6 are similar to those in FIG. 4, but the large reduction in lifetime is attributed mostly to the increased discharge voltage and erosion that results from the higher operating temperature, 2400-2500 K versus 1400-1500 K. Because of this large reduction in lifetime, the conductive heat loss path from surface 37 through tip 31B' and tube 31A', that does not contribute directly to the heating of emissive surface 56 is a more serious concern.

Figure 7:
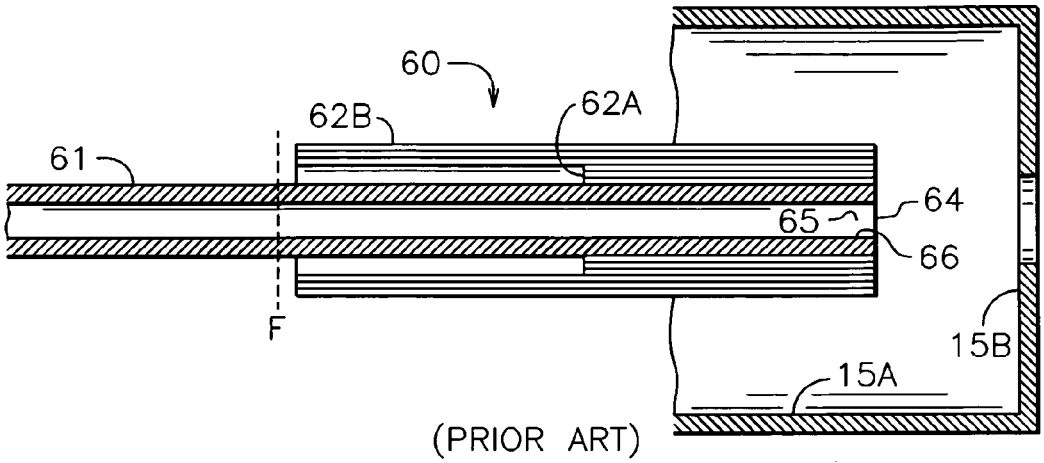
(PRIOR ART) Fig. 7
FIG. 7 shows a cross section of yet still another prior-art hollow cathode.

Referring to FIG. 7, there is shown a cross section of yet still another prior-art hollow cathode. Hollow cathode 60 comprises a hollow tantalum tube 61 having a circular cross section and inner and outer radiation shields 62A and 62B. Radiation shields 62A and 62B each comprise a plurality of shields constructed with spiral, multiple-turn windings of tantalum foil, wound external to the hollow cathode tube 61. Radiation shields 62A and radiation shields 62B are adjacent to each other and to tube 61, without the presence of intervening support structure between either any of the radiation shields or between tube 61 and any of the shields. The term "adjacent" as used herein means immediately preceding or following. "Support structure" refers to support from a source exterior to radiation shields 62A and 62B and tube 61. Textured tantalum foil is used to fabricate radiation shield 62B in order to minimize layer-to-layer contact of the radiation shields. The effect of this texturing is to increase the average thickness of a heat-shield layer by a factor of several over the original 0.013-mm thickness of the foil. More details on the dimensions and construction of this hollow cathode can be found in the aforementioned U.S. Patent Application Publication 2004/0000853—Kaufman, et al. An enclosed ignitor/keeper with cylindrical wall 15A and apertured end 15B is also shown in FIG. 7. The electrons that pass through open end 64 of tube 61 come from volume 65 near the aperture, and mostly originate from internal tube surface 66 adjacent to volume 65. Except that longer lifetime is obtained through more efficient thermal control, the starting and operation of hollow cathode 60 is similar to that of hollow cathode 10. An important failure mode is a failure of tantalum tube 61 at approximately the axial location indicated by the dashed line F shown in FIG. 7. This failure is due to the formation of cracks in tube 61 that permit much of the working gas to escape before reaching opening 64, thus preventing the starting or normal operation of the hollow cathode. Similar to hollow cathode 50, the failure can also be more dramatic in that tube 61 completely separates at that location. This type of failure is also discussed further near the end of this section.

There can also be a question of whether a continuous spiral winding of tantalum foil, such as shown in insert 52 of FIG. 6 or radiation shields 62A and 62B in FIG. 7, is a thermally conductive path or a plurality of radiation shields. For the several millimeter diameters of the windings and the 0.013-mm thickness of the foil, the radiation heat transfer from layer-to-layer at temperatures near 2400 K is much greater than the conductive heat transfer along the length of the spiral. Such a spiral winding of foil therefore performs more as a plurality of radiation heat shields than it does as a spiral conductive heat path, and is assumed to be a plurality of heat shields herein. This is in addition to the obvious distinction that the construction comprises multiple layers in approximately the circumferential direction, as opposed to a simpler and more substantial path in a radial direction.

Figure 8:
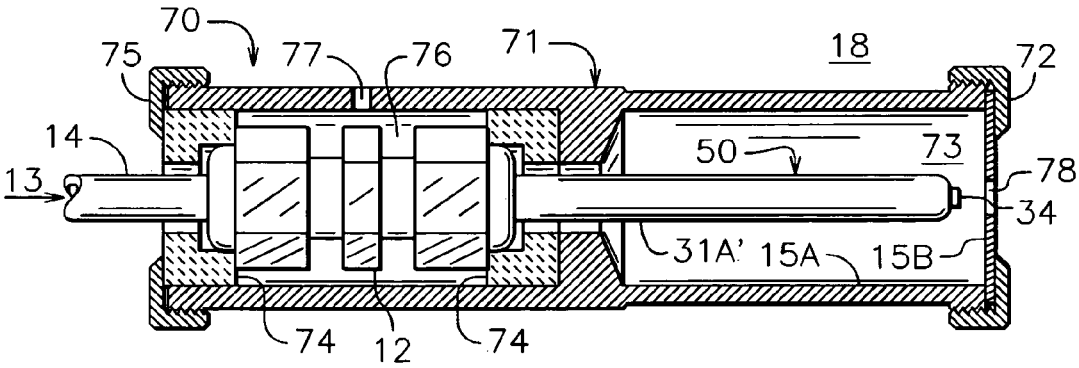
(PRIOR ART) Fig. 8
FIG. 8 shows a cross section of a prior-art hollow-cathode assembly incorporating the hollow cathode shown in FIG. 6.

The enclosed ignitor/keeper can be better understood by reference to FIG. 8, where hollow cathode 50 is incorporated in hollow-cathode assembly 70. Hollow cathode 50 is assembled within main body 71, one end of which forms igniter/keeper cylindrical wall 15A. Apertured end 15B is a separate part that is held in contact with cylindrical wall 15A by screw fitting 72. Main body 71, cylindrical wall 15A, and apertured end 15B enclose volume 73. Cathode holder 12 in this design is a union fitting between tantalum tube 31A' and gas feed tube 14. Cathode holder 12 is separated from and positioned relative to main body 71 by insulators 74. Cathode holder 12 and insulators 74 are held in position in main body 71 by screw fitting 75. Volume 76 adjacent to cathode holder 12 is vented to surrounding volume 18 by vent hole 77. From a functional viewpoint, an enclosed ignitor/keeper is defined as one in which most of the ionizable working gas from the hollow cathode must pass through the ignitor/keeper aperture (78 in FIG. 8). In contrast, an ordinary or non-enclosed ignitor/keeper permits much or most of the ionizable working gas to flow around the outside of the ignitor/keeper (see igniter/keeper 15 in FIG. 1, 4, or 5).

The discharge with an enclosed ignitor/keeper of the type shown in FIG. 8 can be started by applying a positive potential of approximately 1 kV to main body 71 (including igniter/keeper 15A/15B) relative to cathode 50. The ionizable working gas enters volume 73 through cathode opening 34 and leaves through igniter/keeper aperture 78, so that the pressure in volume 73 is intermediate of the pressure in cathode opening 34 and surrounding volume 18. Because of the intermediate pressure in volume 73, the starting discharge is concentrated in this volume, thereby heating hollow cathode 50 to approximately operating temperature while starting the discharge. That is, a discharge between cathode 50 and igniter/keeper 15A/15B is the heating means to bring cathode 50 to operating temperature. After the discharge is started to the igniter/keeper, the current to the igniter/keeper is maintained at about 1.5 A, which corresponds to a cathode-keeper voltage $\leqq$50 V and is usually in the 20-30 V range.

The electrical circuit diagram for operating cathode assembly 50 is similar to that shown in FIG. 3, with hollow-cathode assembly 50 replacing hollow cathode 21 and igniter/keeper 15A/15B replacing ignitor/keeper 15. Because the cathode heating is provided by igniter/keeper power supply 23, power supply 26 and resistive heater 27 are not required. Operation is completed by using discharge power supply 24 to cause the electron emission to the anode. (The anode is 17 in FIG. 3 and is not shown in FIG. 8.)

Figure 9:
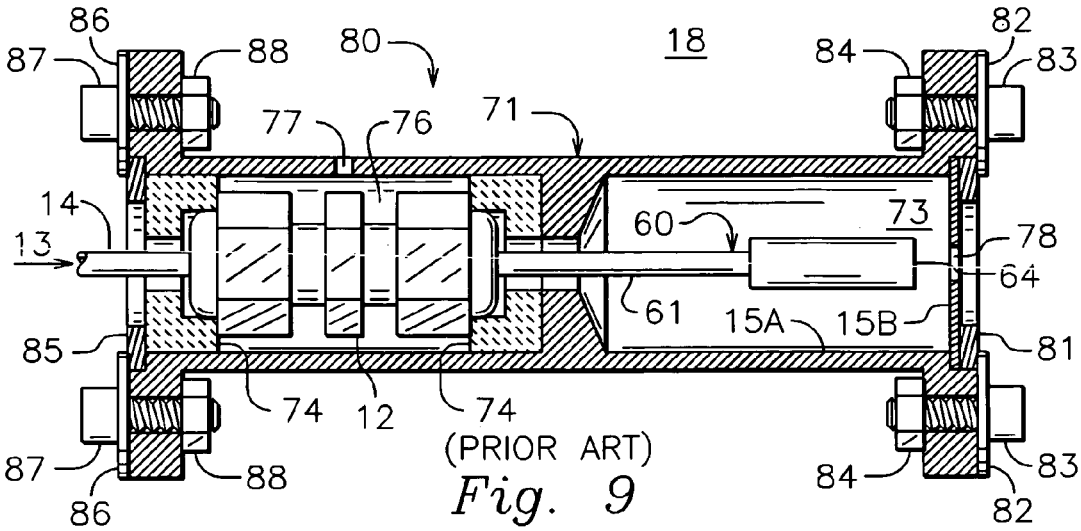
(PRIOR ART) Fig. 9
FIG. 9 shows a cross section of another prior-art hollow-cathode assembly incorporating the hollow cathode shown in FIG. 7.
Figure 10:
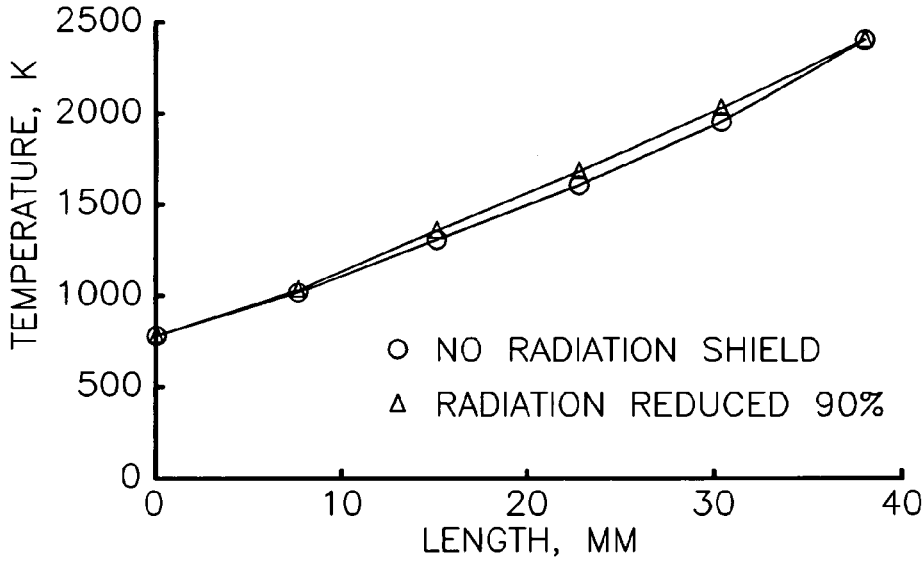
FIG. 10 shows temperature distributions over the length of a hollow cathode.

Referring to FIG. 9, there is shown hollow-cathode assembly 80, which differs from hollow-cathode assembly 70 primarily in using hollow cathode 60 instead of hollow cathode 50. Hollow cathode 60 is assembled within main body 71, one end of which forms igniter/keeper cylindrical wall 15A. Apertured end 15B is a separate part that is held in contact with cylindrical wall 15A by retainer 81, which in turn is held in position by washers 82, screws 83, and nuts 84. Main body 71, cylindrical wall 15A, and apertured end 15B enclose volume 73. Cathode holder 12 is a union fitting between tantalum tube 61 and gas feed tube 14 and provides a support means for tantalum tube 61. Cathode holder 12 is separated from and positioned relative to main body 71 by insulators 74. Cathode holder 12 and insulators 74 are held in position in main body 71 by retainer 85, which in turn is held in position by washers 86, screws 87, and nuts 88. Volume 76 adjacent to cathode holder 12 is vented to surrounding volume 18 by vent hole 77. Startup and operation is similar to that described in connection with FIG. 8.

To summarize the prior art of hollow cathodes, the simple tubular hollow cathode of Delcroix, et al., withstands exposure to atmosphere very well, but it has a very short lifetime. The space electric-propulsion hollow cathodes, with an insert coated or impregnated with emissive material, can have extremely long lifetimes, but cannot withstand repeated exposure to atmosphere. The compromise hollow cathode with a spiral-wound foil insert that has no additional emissive material has an acceptable lifetime if the number of exposures to atmosphere is limited. With repeated exposures, the foil insert also fails.

The hollow cathodes shown in FIGS. 6 and 7 are both capable of reaching lifetimes that are adequate for most industrial applications. In addition, they are both constructed of refractory materials and are not subject to the more severe effects of repeated atmospheric exposure that occur with the use of more reactive emissive materials—see discussions of FIGS. 4 and 6. However, the hollow cathodes shown in FIGS. 6 and 7 both show shortcomings when operated with contaminated working gas. In addition to severe flaking of the tantalum-foil insert of cathode 50 with repeated atmospheric exposure, cathodes 50 and 60 both show rapid structural degradation when operated with contaminated working gas. This structural degradation was similar for both cathodes and consisted of either the formation of cracks in the tantalum tubes (31A' in FIGS. 6 and 61 in FIG. 7) or complete separation of those tubes. What was most surprising was that this structural damage in both cathodes was confined to narrow regions—near dashed lines F in FIGS. 6 and 7.

A review of literature was made to find a possible explanation for the extremely localized damage due to impurities. The absorption of contaminants in "getters" was studied in vacuum tube technology, where the removal of these contaminants was necessary for the proper operation of the vacuum tubes. As described by Spangenberg in the book entitled *Vacuum Tubes*, McGraw-Hill Book Company, New York (1948), beginning on page 809, tungsten, molybdenum, and tantalum, the most common materials for hollow cathodes, have all been used as getters. Information from Spangenberg in the aforementioned book, *Vacuum Tubes*, and Dushman in the book entitled *Scientific Foundations of Vacuum Technique*, John Wiley & Sons, New York (1962), beginning on page 624, can be summarized. Most of the absorption and/or reaction of getter materials with reactive gases takes place over only a narrow temperature range. Below this range, the adsorption and reaction rates are small and the amounts of gases adsorbed or reacted are therefore small. Above this range, the high temperature of the getter material drives the gases out of it. For tantalum, the effective range for gettering is about 700-1200 C. Several reactions are involved. Oxygen and nitrogen can react with the getter to form oxides and nitrides. Water and hydrocarbons can dissociate to form oxides and carbides. The hydrogen from the dissociation can be directly absorbed into the getter. The formation of the oxides, nitrides, and carbides in the getter material will change its physical dimensions, reduce ductility, and introduce stresses. The absorption of hydrogen can cause embrittlement. These processes explain the formation or cracks in, or rupture of, the tantalum hollow-cathode tubes, while the narrow temperature range for these processes to take place explains the compact physical location for the damage.

The temperature distribution of 38-mm long tantalum tube 61 of hollow cathode 60 was calculated and presented in the aforementioned U.S. Patent Application Publication 2004/0000853—Kaufman, et al., for both no radiation shielding and a reduction in radiated heat loss of 90 percent. These two thermal conditions were believed to bracket the actual temperature distribution and their average value at the location of maximum damage was about 1200 C, which is the upper end of the gettering range given for tantalum. The gettering literature of Spangenberg and Dushman thus agrees with the nature of the damage to hollow cathodes 50 and 60 that resulted from the use of contaminated working gas. In the case of hollow cathode 60, it was also possible to find agreement for the location.

It may be noted that hollow cathodes 30 and 40 did not exhibit failures of the gas confining tubes as described above. But that lack of failure was only due to the more rapid failure of the reactive emissive materials in inserts 32 and 42. Without these emissive materials, those cathodes were unable to operate in the temperature range of 1400-1500 K for which they were designed.

DESCRIPTION OF PREFERRED EMBODIMENTS

Figure 11:
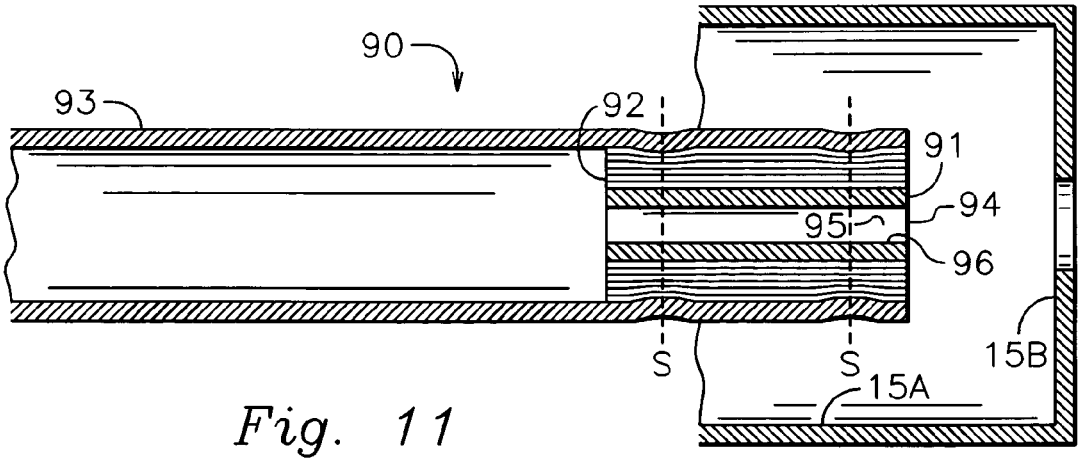
FIG. 11 is a cross section of an embodiment of the present hollow-cathode invention.

Referring to FIG. 11, there is shown an embodiment of the present invention. Hollow cathode 90 comprises refractory-metal first tube 91, which is surrounded by plurality of refractory-metal radiation shields 92, which in turn is surrounded by refractory-metal second tube 93. A radiation shield is defined herein as a single layer that circumferentially encloses the hollow-cathode tube. As described in the prior art, this definition is consistent with radiation heat transfer from layer-to-layer being much greater than conductive heat transfer along a spiral winding for the dimensions, temperatures, and foil used. A plurality of shields is therefore conveniently constructed as a spiral, multiple-turn winding of refractory-metal foil, or a plurality of such windings. In order to minimize the layer-to-layer contact between shields in a spiral winding, the metal foil may be textured before winding. The foil can textured by pressing it against a rough or corrugated surface, which imparts a similar shape to the foil.

Shields 92 end approximately flush at the two ends of first tube 91, that is, approximately in the planes of these two ends. One end of second tube 93 is also approximately flush at the corresponding end of the first tube, that is, approximately in the plane of that end. Radiation shields 92 are compressed between first tube 91 and second tube 93. In FIG. 11 this compression is accomplished by swaging second tube 93 to a smaller diameter at two axial locations indicated by dashed lines S. This swaging of second tube 93 compresses radiation shields 92 between it and first tube 91, as well as preventing the leakage of gas around the first tube. The texturing of the foil of which the radiation shields are fabricated permits considerable reduction in the outer diameter where the swaging occurs without significantly degrading the radiation shielding effectiveness. The compression could have been accomplished by expanding the first tube. It could also be accomplished by using a conically tapered surface on the outside of the first tube and/or the inside of the second tube so that sliding the parts into position accomplished the compression. An enclosed ignitor/keeper with cylindrical wall 15A and apertured end 15B is also shown in FIG. 11.

First tube 91, radiation shields 92, and second tube 93 are adjacent to each other without the presence of intervening support structure between any of the adjacent radiation shields, between the first tube and the inner radiation shield, or between the outer radiation shield and the second tube. The term "adjacent" as used herein means immediately preceding or following. "Support structure" refers to support from a structural member other than radiation shields 92, first tube 91, and second tube 93. Refractory material (e.g. in the form of particulates) could be included between adjacent radiation shields, or between the inner shield and first tube 91, or between the outer shield and second tube 93, and serve the same function as texturing. The presence of such refractory material is not considered to be intervening support structure in this invention because it does not connect to a structural member other than the first and second tubes and the radiation shields.

First tube 91 should be attached to radiation shields 92. This can be done by spot welds of the inner end of the spiral winding that is radiation shields 92 to first tube 91. No similar attachment was required where radiation shields 92 contact second tube 93, presumably because of both the larger contact area at this location and the lower temperature.

The operation is generally similar to other hollow cathodes. There is a discharge between hollow cathode 90 and enclosed ignitor/keeper 15A/15B and or an external cathode (not shown in FIG. 11). This discharge generates electrons and ions by ionization of atoms or molecules of the working gas. Some of the ions are carried with the flow of working gas and, together with the emitted electrons form a conductive plasma that extends from volume 95 inside open end 94 of cathode 90 to igniter/keeper 15A/15B and the anode. The electrical conductivity of this plasma permits the operation with an anode-cathode (or ignitor/keeper-cathode) voltage of <50 V and consistent with a long operating lifetime. The electrons that pass through open end 94 come from volume 95 near the open end, and mostly originate from internal tube surface 96 adjacent to volume 95.

The uniqueness of hollow cathode 90 is in the absence of a continuous piece of refractory metal extending from the open end of the hollow cathode to the cathode support, which confines the working gas, and is subject to failure in the confining function when exposed to high levels of contamination in the working gas. Prior-art examples of such a continuous piece of refractory metal are hollow-cathode tube 11 in FIGS. 1 and 2, tip 31B and tube 31A which are electron-beam welded into one continuous piece in FIGS. 4 and 5, tip 31B' and tube 31A' which are a continuous piece of tantalum in FIG. 6, and tube 61 in FIG. 7. This absence has two important benefits. One is the reduction of heat loss by removing a major thermal conduction path for this loss, which permits operation at a lower discharge voltage and has a beneficial effect on lifetime. The other important benefit is to reduce the effect of contamination in the working gas. The first tube is near the electron emission temperature and is above the critical temperature range for absorbing or reacting with contaminants. The large tube is much closer to the support temperature and is below this critical temperature range. The temperature of some of the radiation shields will fall in the critical temperature range. The absorption of or reaction with contaminants near the critical temperature range will cause distortion or fracture of some of the radiation-shield layers. But the compression between layers will hold fractured or distorted pieces in place, while the length of the microscopic passages between layers will effectively seal the space between the first tube and the second tube and force almost all of the working gas through the first tube. In this manner hollow cathode 90 is more resistant than prior-art hollow cathodes to containment failures for the working gas as a result of contamination in that working gas.

Figure 11A:
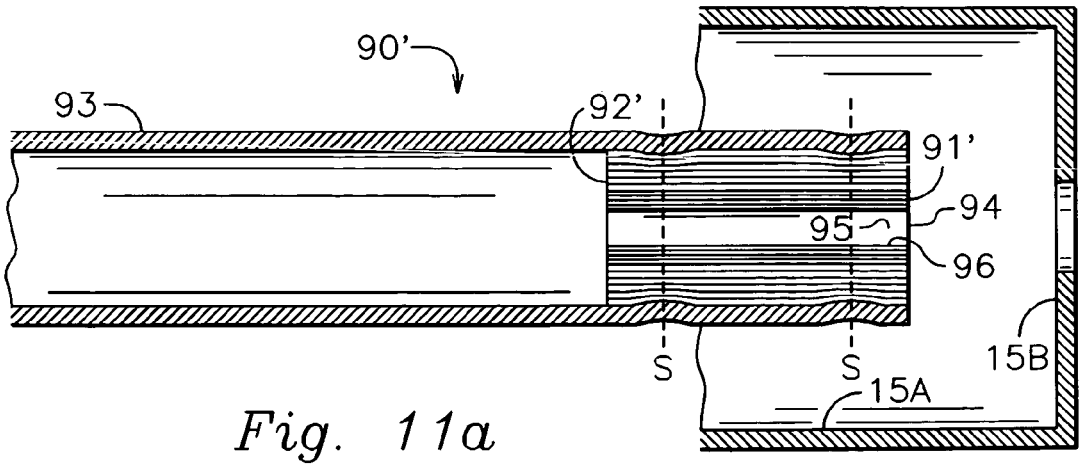
FIG. 11*a* is a cross section of another embodiment of the present hollow-cathode invention.

Referring to FIG. 11*a*, there is shown another embodiment of the present invention, hollow cathode 90'. Hollow cathode 90' differs from hollow cathode 90 in FIG. 11 only in the construction of the first tube and the plurality of radiation shields. First tube 91' and plurality of radiation shields 92' are fabricated from one continuous piece of refractory-metal foil. The portion of the foil used to make first tube 91' is not textured, so that the density of this portion approximates the density of solid metal. The transition from the smooth foil of first tube 91' to the textured foil of radiation shields 92' provides the attachment between the two. Although the absence of texturing was used to make the first tube have a density significantly greater than the surrounding heat shields, such a density difference could have been generated with a difference in the tension of the foil while winding the first tube and the radiation shields.

Figure 12:
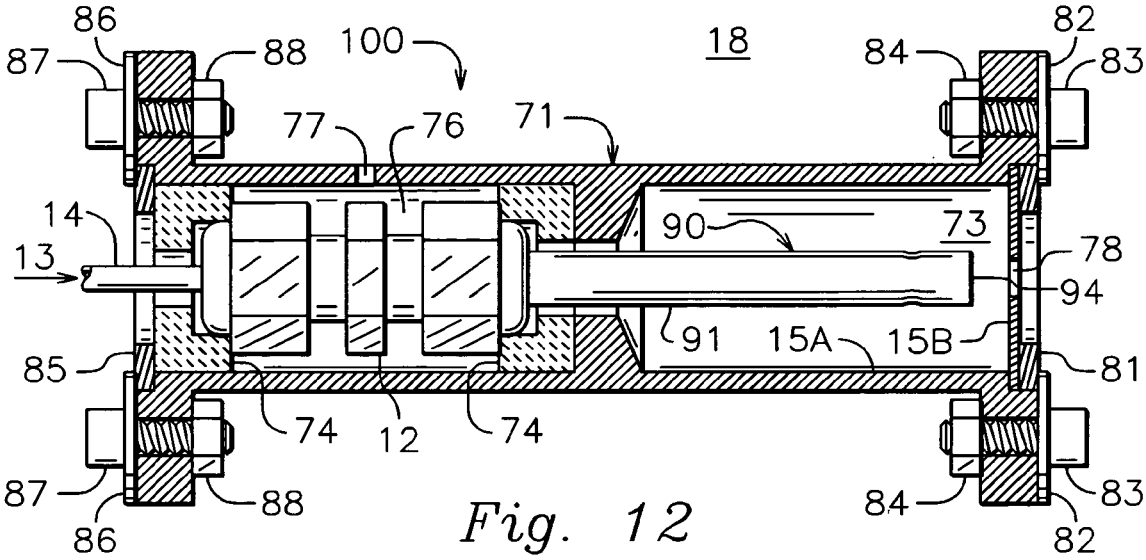
FIG. 12 shows a hollow-cathode assembly incorporating an embodiment of the present invention shown in FIG. 11.

In FIG. 12, hollow cathode 90 is incorporated in hollow-cathode assembly 100. Hollow cathode 90 is assembled within main body 71, one end of which forms igniter/keeper cylindrical wall 15A. Apertured end 15B is a separate part that is held in contact with cylindrical wall 15A by retainer 81, which in turn is held in position by washers 82, screws 83, and nuts 84. Main body 71, cylindrical wall 15A, and apertured end 15B enclose volume 73. Cathode holder 12 is a union fitting between second tube 93 and feed tube 14 and provides a support means for second tube 91. Cathode holder 12 is separated from and positioned relative to main body 71 by insulators 74. Cathode holder 12 and insulators 74 are held in position in main body 71 by retainer 85, which in turn is held in position by washers 86, screws 87, and nuts 88. Volume 76 adjacent to cathode holder 12 is vented to surrounding volume 18 by vent hole 77.

Figure 12A:
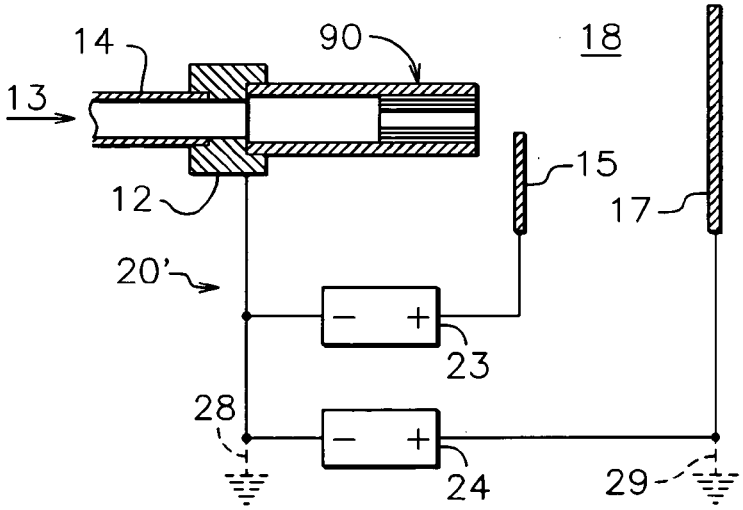
FIG. 12*a* shows an electrical circuit diagram of a hollow cathode incorporating an embodiment of the present invention shown in FIG. 11.

The starting and operation of hollow cathode 90 and hollow-cathode assembly 100 is similar to that described for hollow cathodes 50 and 60 and hollow-cathode assemblies 70 and 80. The electrical circuit diagram is shown in FIG. 12*a* and is similar to that shown in FIG. 3, except that heater power supply 26 and resistive heater 27 are not required and hollow cathode 90 replaces hollow cathode 21.

Tantalum is the most common hollow-cathode material because it withstands high operating temperatures and is easily formed or machined. Tungsten has also been used and provides a higher temperature capability with a generally higher fabrication cost. Molybdenum is easily machined, but has less temperature capability than tantalum. Carbon, considered a metal for the discussion herein, also provides higher temperature capability but with decreased strength. Hollow cathodes have been made of refractory metals such as these, as well as alloys of two or more metals.

DEMONSTRATION OF RESISTANCE TO CONTAMINATION

Figure 13:
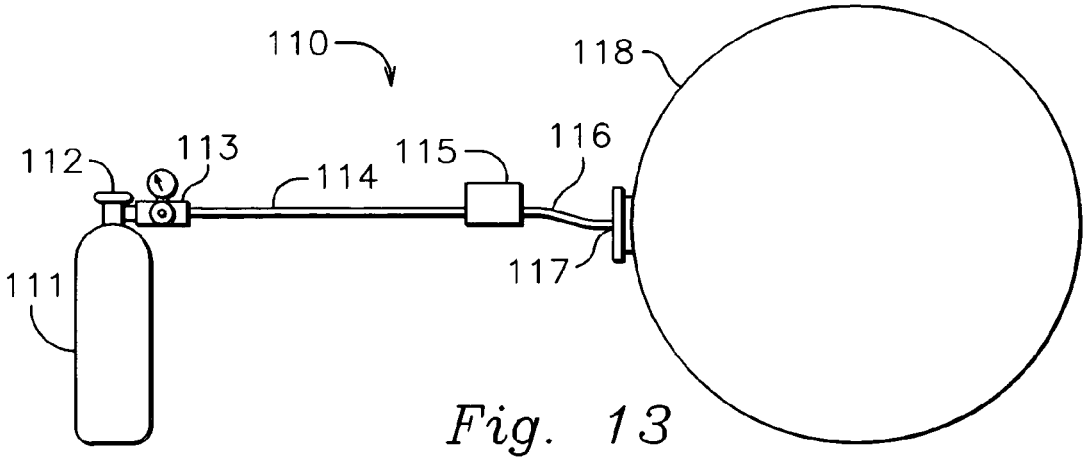
FIG. 13 is a gas feed system for a hollow cathode.

Tests were carried out to demonstrate the improved capability of a hollow cathode constructed in accord with this invention to withstand the adverse effects of contaminated working gas. To provide realistic and reproducible contaminated working gas, a gas feed system was modified. A typical gas feed system is shown in FIG. 13. Feed system 110 is comprised of gas bottle 111, gas-bottle valve 112, gas regulator 113, first gas line 114 connecting the gas regulator and gas flow controller 115 (often called a mass flow controller), second gas line 116 connecting the gas flow controller and gas feedthrough 117, which introduces the gas to vacuum chamber 118. Although it is not shown in FIG. 13, the gas flow is conducted to a hollow cathode inside the vacuum chamber.

Some of the usual sources of contamination are: using a gas regulator that is not intended for high-purity applications, using gas lines that have not been thoroughly cleaned, and not making leak-tight connections between the gas lines and the gas regulator, gas flow controller, and feedthrough. Stainless-steel tubing is preferred for the gas lines, but an internal residue left from its fabrication can contaminate the gas flowing through it unless it is cleaned thoroughly. Polymer tubing is a less acceptable choice for a gas line, in that even when clean, its more porous structure can result in water vapor and hydrocarbon contamination of the gas flowing through it. The connections at the ends of second gas line 116 are more frequently a source of contamination than those of first gas line 114 because the gas in the second gas line is usually below atmospheric pressure during operation, so that the atmosphere can leak into the gas line. In comparison, the pressure in first gas line 114 is usually at or above atmospheric pressure. The connections inside the vacuum chamber are usually not a problem because the pressure inside the vacuum chamber is usually less than that in the gas tubing. The replacement of gas bottles is a common source of contamination. If the regulator is attached to a new gas bottle and then opened without pumping down the gas line, the trapped atmosphere between the regulator and the new gas bottle will mix with the clean gas in the bottle (typically >99.999 percent purity) and contaminate it. The proper procedure is to connect the gas bottle to the gas regulator, pump down the vacuum chamber to operating pressure, fully open both the gas flow controller and gas regulator, and continue to operate the vacuum pumps until the vacuum chamber reaches its normal base pressure. Then, with the volume between the gas bottle and the gas regulator pumped to a low pressure by the vacuum chamber, close the gas regulator and open the valve on the gas bottle. An additional purge is then required to remove the adsorbed contaminants from atmospheric exposure on the inside of the gas lines and the gas flow controller.

Figure 14:
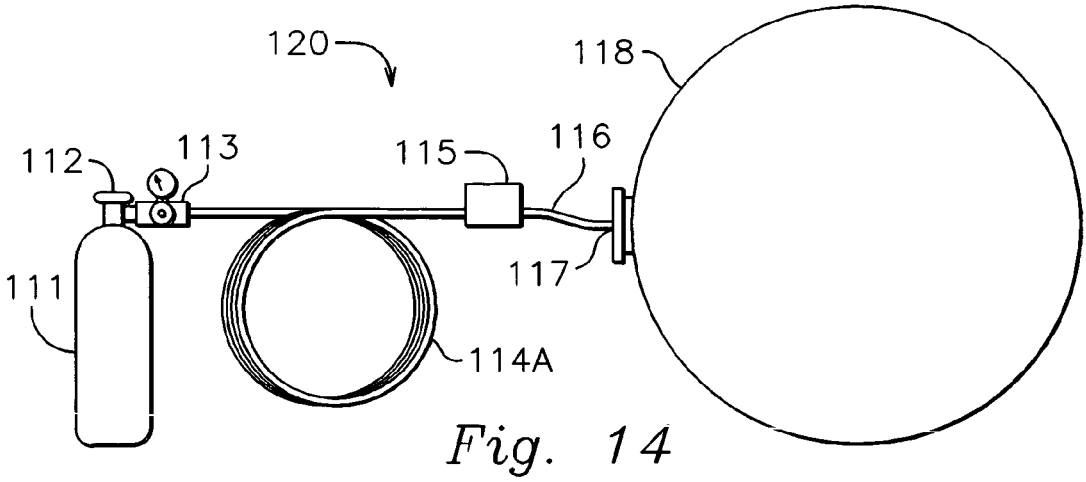
FIG. 14 is a gas feed system for a hollow cathode modified to introduce contamination into the working gas.

The procedure used to introduce a controlled level of contamination into the working gas can be explained with reference to FIG. 14. The only change in gas feed system 120 compared to that of feed system 110 is the replacement of first gas line 114, which was constructed of clean stainless steel tubing, with modified first gas line 114A, which was comprised of 30 meters of 6.35-mm-diameter nylon tubing. A normal gas purge was used before operating a hollow cathode, so that the contamination consisted of a thin layer of atmospheric contaminants (usually oxygen, nitrogen, water vapor, and some hydrocarbons from the laboratory background) adsorbed on the surface of the nylon tubing plus similar contaminants absorbed into the nylon. There was probably some additional hydrocarbon in the form of residual plasticizer in the nylon. To make sure that the nylon tubing did not gradually become cleaner, the nylon tubing was re-exposed to the atmosphere whenever a new hollow cathode was tested or whenever the operating time after the previous atmospheric exposure exceeded 48 hours, whichever came first. It should be emphasized that this contamination test is a severe one. In the absence of contamination and with only occasional exposure to atmosphere, the typical lifetime of either hollow cathode 50 or 60 was of the order of 1000 hr. Previous operation had shown that 20-30 cm of polymer tubing in an otherwise clean gas line was sufficient to dramatically reduce this lifetime. By using 30 meters of polymer tubing, a very high level of contamination was being introduced.

A failure was defined in either of two ways. Either emission could not be sustained or the hollow cathode could not be restarted. For operating times less than 48 hours, the failures were all of the first type. For operating times longer than 48 hours, the failure was an inability to restart the hollow cathode after operation was stopped to expose the nylon tube to atmosphere. The maximum argon flow used for starting was 100 sccm. Visual appearance of the hollow cathode was not a consideration in defining a failure.

The first test was of hollow cathode 60 shown in FIG. 7 and described in the aforementioned U.S. Patent Application Publication 2004/0000853—Kaufman, et al. The tantalum tube of this hollow cathode was 1.57 mm in outside diameter and 38 mm long, with a wall thickness of 0.38 mm. It was operated with an argon gas flow of 10 sccm (standard cubic centimeters per minute), a keeper current of 1.5 A, and an emission of 5 A. Several tests were made with the working gas contaminated as described above, resulting in lifetimes of 1-5 hours before failing. Although these lifetimes were shorter than were found in actual industrial applications, presumably due to a higher level of contamination, the appearance of the failures was indistinguishable from that of prior failures found in industrial applications. This similarity in appearance means that the effects of the test impurities are similar to the effects in industrial applications. Using the same number of radiation shields, but increasing the tube diameter to 3.18 millimeters and the wall thickness to 1.17 mm increased the lifetime to 8 hours. Apparently more material in the tantalum tube increased the time to failure, without changing the failure process.

A test was also made of the prior-art hollow cathode shown in FIG. 6. The outside diameter of tantalum tube 31A' was 6.4 mm for this hollow cathode with a wall thickness of 0.5 mm, and the lifetime was increased to 144 hours. The longer lifetime for this hollow cathode was felt to be due in part to the larger tube diameter and the greater amount of material available to absorb contamination. However, at the end of the test, cracks were nearly continuous around the body of the hollow cathode near dashed line F in FIG. 6.

The invention described herein was also tested using the configuration shown in FIG. 11*a*. The first (tantalum) tube had an outside diameter of approximately 1.6 mm, while the inside diameter was approximately 0.8 mm. The axial length of the first tube and radiation shields was 25 mm. Because the small tube was constructed of tantalum foil, these diameters are less precise than those for solid tubing. The radiation shields were wound to a diameter just small enough to fit inside the second (tantalum) tube, which had a outside diameter of 6.4 mm, a wall thickness of 0.5 mm, and a length of 64 mm. The lifetime of this hollow cathode was 240 hours. From the severe nature of this test, a lifetime of 240 hours with such a high level of contamination should translate into useful lifetimes of at least several hundred hours at more realistic levels of contamination. Even though the lifetime was longer with the configuration of FIG. 11*a*, the cracks in the 6.4 mm tube were much less extensive at the end of test than the corresponding cracks in the configuration of FIG. 6. This result indicated that the outer tube of the former operated at a lower temperature and had less of a gettering effect than the outer tube of the latter.

DESCRIPTION OF ALTERNATE EMBODIMENTS

Figure 15:
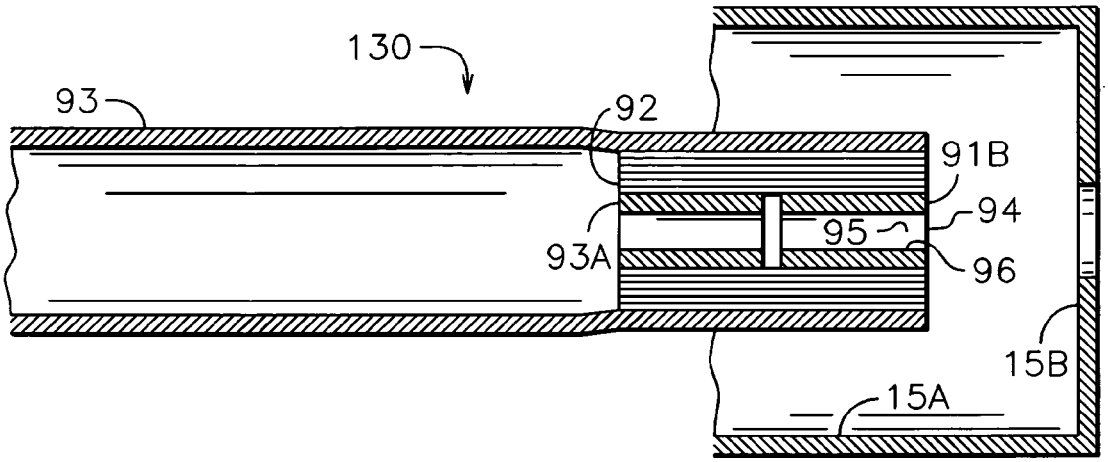
FIG. 15 is a cross section of yet another embodiment of the present invention.

Referring to FIG. 15, there is shown another embodiment of the present invention. Hollow cathode 130 differs from hollow cathode 90 in having first tube 91 divided into two pieces 91A and 91B. Depending on the operating conditions and hollow-cathode dimensions, such a change could reduce thermal losses. Also shown in FIG. 15 is an extended region of swaging, instead of the more localized swaging of FIG. 11.

Figure 16:
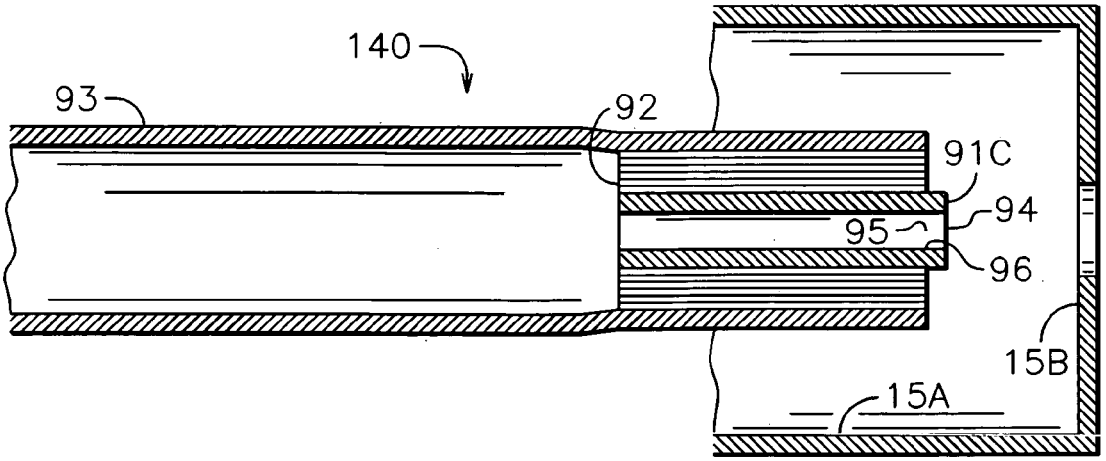
FIG. 16 is a cross section of still another embodiment of the present invention.

Referring to FIG. 16, there is shown yet another embodiment of the present invention. Hollow cathode 140 differs from hollow cathode 90 (in addition to the difference in swaging) in having small tube 91C extend beyond the ends of radiation shields 92 and large tube 91. Such a change in the small tube can reduce the thermal efficiency slightly in that more area of the small tube can radiate directly to the surroundings instead of being shielded by the radiation shields. But the extension can also increase the ease of starting a discharge.

Other changes should be evident to those skilled in the art. Tubes with circular cross sections and generally cylindrical configurations are typical in hollow cathodes. Tubes with circular cross sections were used in tests of the configurations shown in FIGS. 11 and 11*a*, and are reasonable to assume for those of FIGS. 15 and 16. It should be apparent that tubes with other cross sections, such as triangular, square, rectangular, or elliptical are possible, with the radiation shields accommodating the tubing shape. In a similar manner, radiation shields are assumed to be comprised of spiral windings of thin material. The radiation shields could also be comprised of many turns of fine refractory filament or wire, or they may be comprised of concentric cylinders instead of a spiral winding of foil.

Different lengths of tubing and radiation shields could also be used. The configuration of this invention used in the contamination test had an axial length for the first (inner) tube of about 16 times the outside diameter of that tube. Longer lengths could probably be used, but would tend to increase the heat loss and decrease lifetime. Experience with a variety of hollow cathodes has shown that the internal erosion typically extends back inside the tube for a length equal to several outside diameters of that tube, so the minimum length of the inner tube should be equal to about 4-5 outside diameters of that tube. The inside diameter of the first tube should be roughly half of its outside diameter. Larger inside diameters can be used, but will reduce the amount of material available for erosion, hence reduce the lifetime. Smaller inside diameters can be used, but are more likely to fail due to closing up completely. The length of the shields must also be considered relative to the diameter of the second (outer) tube. If the shields are too short, less than about equal to the diameter of the second tube, it would be difficult to keep them in place while they are being compressed between the first and second tubes. That is, they would tend to move back into the second tube, or out the end of it. In general, the flush ending of the second tube with one end of the radiation shields is preferred. Extending this tube beyond the radiation shields can make starting more difficult, while ending it before the end of the radiation shields can degrade the structural integrity of the hollow cathode by not fully supporting the radiation shields.

The number of radiation shields can also be varied. Simple one-dimensional analysis will show that the radiation heat loss will vary approximately as 1/N, where N is the number of heat shields. It would therefore be expected that about 10 or more heat shields would be required to obtain most of the beneficial effects of heat shields. In practice, there is a tendency of heat shields to weld together when operated for a long time at very high temperatures, thereby providing an increasingly direct path for heat conduction. (This is probably the failure mode for the simple heat shields suggested by Delcroix, et al, in the aforesaid chapter in Vol. 35 of *Advances in Electronics and Electron Physics*.) Texturing of the heat-shield material tends to slow this welding process, but for high heat-shield efficiency over long operating lifetimes, 20, 30, or even more heat shields are preferred.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

We claim:

1. A hollow-cathode apparatus comprising:

a first refractory-metal hollow tube having first and second open ends, wherein said first open end comprises a means of introducing an ionizable gas to the interior of said first tube;

a plurality of concentric, refractory-metal thermal radiation shields surrounding said first tube; wherein all shields of said plurality are approximately flush with said first and second ends of said first tube; and wherein said radiation shields are adjacent to each other and support said first tube without intervening support structure between said first tube and the innermost of said plurality of radiation shields or between any adjacent pair of said plurality of radiation shields;

a second refractory-metal hollow tube having first and second open ends, having a length equal to or greater than said first tube, and having an inside diameter approximately equal to the outside diameter of the said plurality of radiation shields; wherein said second tube surrounds said plurality of radiation shields without any intervening structure between the outside of said radiation shields and the inside of said second tube; wherein said first end of said second tube comprises a means of introducing an ionizable gas to the interior of said second tube and thence to the interior of said first tube; and wherein said second end of said second tube is approximately flush with said second end of said first tube; and a means for compressing said plurality of radiation shields between said first tube and said second tube thereby supporting said plurality of radiation shields by said second tube and supporting said first tube by said plurality of radiation shields and thereby further preventing leakage of said ionizable gas around said first tube.

2. A hollow-cathode apparatus as defined in claim 1 wherein at least some of said plurality of said radiation shields comprise a spiral winding of refractory-metal foil.

3. A hollow-cathode apparatus as defined in claim 1 wherein said first tube is comprised of a continuous spiral winding of thin refractory metal.

4. A hollow-cathode apparatus as defined in claim 1 wherein said first tube and said plurality of radiation shields are comprised of a single, continuous, closely-wound spiral winding of thin refractory metal.

5. A hollow-cathode apparatus as defined in claim 1 wherein said first tube is comprised of two tubes having similar diameters aligned coaxially with each other and having a separation therebetween.

6. A hollow-cathode apparatus as defined in claim 1 wherein said second end of said first tube extends beyond said plurality of said radiation shields.

7. A hollow-cathode apparatus as defined in claim 1 wherein said first and second tubes and said plurality of radiation shields are comprised of tantalum.

8. A hollow-cathode apparatus as defined in claim 1 wherein said hollow-cathode apparatus also includes a heating means for increasing the temperature of said first tube near said second end and wherein said heating means comprises an electrical discharge between said first tube and an additional electrode external to said first and second tubes and said plurality of said radiation shields.

9. A method for constructing a hollow cathode, the method comprising the steps of:

(a) providing a first refractory metal hollow tube having first and second open ends;

(b) providing an electrode near said second end of said first tube;

(c) surrounding said first tube with a plurality of concentric thermal radiation shields wherein all shields of said plurality are approximately flush with said first and said second ends of said first tube, and wherein said radiation shields are adjacent to each other and support said first tube without intervening support structure between said first tube and the innermost of said plurality of radiation shields or between any adjacent pair of said plurality of radiation shields;

(d) providing a second tube having first and second open ends, having a length equal to or greater than said first tube, wherein said second tube surrounds said plurality of said radiation shields and wherein said second end of said second tube is approximately flush with said second end of said first tube;

(e) providing a means for compressing said plurality of said radiation shields between said second tube and said first tube and wherein said second tube is in contact with the outermost of said radiation shields, each of said radiation shields is in contact with adjacent ones of said radiation shields, and the innermost of said radiation shields is in contact with said first tube, all without support from other structural members, thereby sealing the space between said first and second tubes to prevent leakage of an ionizable gas between said first and second tubes;

(f) supporting said second tube at said first end;

(g) introducing an ionizable working gas to said second tube at said first end;

(h) providing a power supply having positive and negative terminals;

(i) connecting the negative terminal of said power supply to said second tube;

(j) connecting the positive terminal of said power supply to said electrode;

(k) introducing a flow of ionizable working gas to said large tube;

(l) providing a heating means and heating said refractory metal tube to operating temperature;

(m) establishing an electron emission by energizing said power supply to a voltage of greater than several hundred volts; and (n) controlling the electron emission to a predetermined value by adjusting the voltage of said power supply to a value less than 50 volts.

10. A method as defined in claim 9 wherein at least some of said plurality of said radiation shields comprise a spiral winding of refractory-metal foil.

11. A method as defined in claim 9 wherein said first tube is comprised of a continuous spiral winding of thin refractory metal.

12. A method as defined in claim 9 wherein said first tube and said plurality of radiation shields are comprised of a single, continuous, closely-wound spiral winding of thin refractory metal.

13. A method as defined in claim 9 wherein said first tube is comprised of two tubes having similar diameters aligned coaxially with each other and having a separation therebetween.

14. A method as defined in claim 9 wherein second end of said first tube extends beyond said plurality of said radiation shields.

15. A method as defined in claim 9 wherein said first and said second tubes and said plurality of radiation shields are comprised of tantalum.

16. A method in accordance with claim 9 wherein said heating means comprises a discharge between said small tube and said electrode with a potential difference at least initially of approximately 1 kV.

* * * * *